US005233963A

United States Patent [19]

Gregorius et al.

[11] Patent Number: 5,233,963

[45] Date of Patent: Aug. 10, 1993

[54] FUEL DISTRIBUTOR

[75] Inventors: Thomas Gregorius, Gerlingen; Dieter Egert, Waiblingen; Gerhard Schellenberg, Fellbach, all of Fed. Rep. of Germany

[73] Assignee: Robert Bosch GmbH, Stuttgart, Fed. Rep. of Germany

[21] Appl. No.: 867,306

[22] Filed: Apr. 10, 1992

[30] Foreign Application Priority Data

Apr. 12, 1991 [DE] Fed. Rep. of Germany ..... 4111988

[51] Int. Cl.[5] ..... F02M 41/00

[52] U.S. Cl. ..... 123/456; 137/561 A; 123/468; 123/463

[58] Field of Search ..... 137/561 A; 123/468, 123/469, 470, 472, 456, 463

[56] References Cited

U.S. PATENT DOCUMENTS

| | | | |
|---|---|---|---|
| 4,570,601 | 2/1986 | Ito | 123/468 |
| 4,586,477 | 5/1986 | Field | 123/468 |
| 4,601,275 | 7/1986 | Weinand | 123/456 |
| 4,756,289 | 7/1988 | Rock | 123/468 |
| 4,836,246 | 6/1989 | Lemp | 137/561 A |
| 4,903,721 | 2/1990 | Maier | 123/463 |
| 4,955,409 | 9/1990 | Tokuda | 137/561 A |
| 5,056,489 | 10/1991 | Lorraine | 123/468 |
| 5,105,787 | 4/1992 | Imoehl | 123/456 |
| 5,143,039 | 9/1992 | Gmelin | 123/456 |

FOREIGN PATENT DOCUMENTS

| | | |
|---|---|---|
| 0403871 | 12/1990 | European Pat. Off. . |
| 4002393 | 8/1991 | Fed. Rep. of Germany . |

*Primary Examiner*—Carl S. Miller

*Attorney, Agent, or Firm*—Edwin E. Greigg; Ronald E. Greigg

[57] ABSTRACT

A fuel distributor for supplying fuel to a plurality of fuel injection valves of the top feed type, in which the inlet and the return necks are disposed on one end of the fuel distributor, so that mounting of the fuel distributor is simplified and the space required is reduced. A connection cap having a return neck is disposed on the distributor housing, and a central pressure regulator is disposed on its face end on a second end. The pressure regulator and the return neck of the connection cap communicate with one another through a central return line extending within the distributor housing. The fuel distributor is especially suitable for fuel injection systems of mixture-compressing internal combustion engines externally supplied with ignition, for supplying fuel to a plurality of fuel injection valves.

11 Claims, 4 Drawing Sheets

FUEL DISTRIBUTOR

BACKGROUND OF THE INVENTION

The invention is based on a fuel distributor as defined hereinafter. German Patent Application P 40 02 393.1 has already proposed a fuel distributor that serves to supply fuel to a plurality of fuel injection valves of the top feed type, and which has both an inlet and an outlet neck and a number of connection necks corresponding to the number of fuel injection valves; the fuel injection valves can be inserted tightly by their fuel delivery necks into these connection necks. This fuel distributor has the disadvantage that the inlet neck and return neck are disposed on two opposed ends of the fuel distributor. In addition, the pressure regulator is disposed laterally on the housing of the fuel distributor. This proposed fuel distributor requires a large amount of space and can be connected to fuel inlet and return lines only with comparative difficulty.

For a fuel supply unit for a plurality of fuel injection valves to be as compact as possible, it is often necessary to dispose the inlet and return necks spatially close to one another at one end of the fuel distributor, or at least in the vicinity of one end, thus making it possible to connect the fuel distributor on one side.

OBJECT AND SUMMARY OF THE INVENTION

The fuel distributor according to the invention has an advantage over the prior art of a very slender, compact structure, in which the inlet and return necks can be disposed on one end of the fuel distributor or in the vicinity thereof, making a one-sided connection of the fuel distributor to fuel delivery and return lines possible. This not only facilitates mounting the fuel distributor, for instance in the engine compartment of a vehicle, but also reduces the space required or makes better use of the existing space at a suitable location.

The fuel distributor according to the invention can also be manufactured simply and economically.

For the sake of a particularly compact, slender structure of the fuel distributor and for a fuel distributor connection that requires little space, it is advantageous if the connection cap is disposed on the face end of the first end of the distributor housing and the return neck is formed centrally on the connection cap and the inlet neck is formed in the vicinity of the first end of the distributor housing.

To assure a secure hold of the return line in the direction of the longitudinal axis in this distributor housing, it is advantageous if the return line is thrust into a guide segment of the connection cap and has a collar by which it protrudes into a receiving segment of the connection cap, and if a bush engages the collar fixes the return line in the receiving segment.

It is especially advantageous if there is at least one spacer in the inlet cross section of the distributor housing, between the wall of the inlet cross section and the return line; the spacer limits the offset of the return line relative to the longitudinal axis of the distributor housing. This facilitates mounting of the pressure regulator in the distributor housing and lessens the danger that sealing rings disposed on the circumference of the pressure regulator will be severed.

It is advantageous if the spacer has a plurality of radially inwardly pointing cams, vertically of the longitudinal axis of the distributor housing, which radially face a collar of the return line.

To effectively prevent shifting of the pressure regulator along the longitudinal axis of the distributor housing, it is advantageous if there is at least one slit extending vertically to the longitudinal axis on the circumference of the distributor housing, on its second end receiving the pressure regulator; a retaining clamp then protrudes partway through the slit and rests on the circumference of the pressure regulator with an initial stress oriented in the direction of the longitudinal axis.

It is advantageous if a recess is provided on a face end of the distributor housing toward the connection cap; the recess cooperates with a positioning protrusion formed on one face end of the connection cap, thus preventing twisting of the connection cap relative to the distributor housing.

For the sake of simple disposition of a sealing ring, it is advantageous if an annular chamber, in which the sealing ring is disposed, is formed in the direction of the longitudinal axis of the distributor housing between the return line collar and a side face of the receiving segment of the connection cap, and between the circumference of the return line and the wall of the receiving segment.

For the same reason, it is also advantageous if an annular chamber in which the sealing ring is disposed is formed in the direction of the longitudinal axis of the distributor housing between a support flange on the circumference of the connection cap and a bearing face of the distributor housing, and also between the circumference of the connection cap and the wall of the inlet cross section of the distributor housing.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
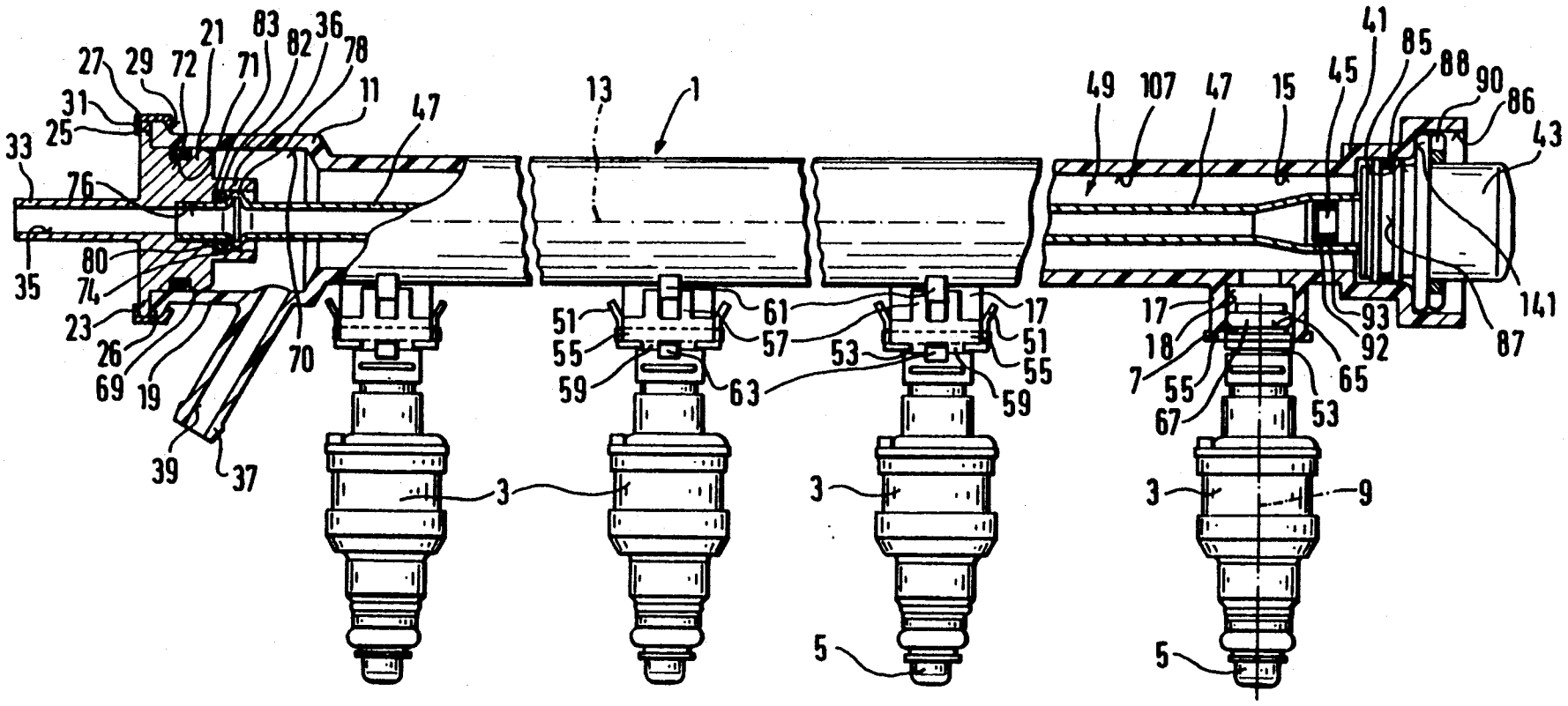
FIG. 1 shows a first exemplary embodiment of a fuel distributor embodied according to the invention.

The fuel distributors shown by way of example in the drawings for fuel injection systems of mixture-compressing internal combustion engines with externally supplied ignition are identified by reference numeral 1. The fuel distributors 1 serve to supply fuel to at least two fuel injection valves 3 of the top feed type, and in the first exemplary embodiment of FIG. 1 there are four such valves, by way of example. Remote from its injection end 5, each fuel injection valve 3 has a fuel delivery neck 7, which extends concentrically with a longitudinal valve axis 9 of the applicable fuel injection valve 3.

The fuel distributor 1 according to the invention comprises a tubular distributor housing 11, which has a stepped continuous through bore 15 which is virtually concentric with a longitudinal axis 13. Because of production tolerances and depending on the manufacturing method selected for the distributor housing 11, which is for instance embodied as an injection molded plastic part or as a pressure diecast aluminum part, the through opening 15 extends only approximately concentrically with a longitudinal axis 13 of the distributor housing 11. The tubular distributor housing 11 has a number of connection necks 17 on its circumference corresponding to the number of fuel injection valves 3 to be supplied with fuel by the fuel distributor 1; in the exemplary embodiment shown, there are four connection necks 17.

The fuel injection valves 3 are inserted by their fuel delivery neck 7, concentrically with their longitudinal valve axis 9, as shown in FIG. 1, into connection openings 18 of the connection necks 17 of the distributor housing 11.

On a first end 19 of the tubular distributor housing 11, approximately concentric with its longitudinal axis 13, a central connection cap 21 is disposed on the end face, protruding partway into the through opening 15 of the distributor housing; by way of example, it may be embodied of aluminum, or of some other metal material or of plastic. The connection cap 21 has a radially outwardly pointing retaining flange 23, which rests on an end face 25 of the first end 19 of the distributor housing 11. A radially outwardly pointing end segment 26 of the first end 19 of the distributor housing 11 and the retaining flange 23 are surrounded by an edge-formed ring 27, which is deformed in such a way that both its edges 29, 31 are oriented radially inward. The connection cap 21 is retained on the distributor housing 11 by the edge-formed ring 27.

A return neck 33 is formed on the connection cap 21, adjoining the retaining flange 23 of the connection cap 21 and remote from the housing 11. The connection cap 21 of the first exemplary embodiment has a central continuous, stepped return opening 35, which beginning at an end 36 of the connection cap 21 protruding into the distributor housing 11 extends through the central return neck 33, which in turn extends approximately concentrically with the longitudinal axis 13.

In the region of the first end 19, there is an inlet neck 37 on the wall of the distributor housing 11; by way of example, it extends at an incline to the longitudinal axis 13 in the direction toward the return neck 33 and has a inlet opening 39 that is open to the through opening 15. The inlet neck 37 can suitably branch off from the same side of the distributor housing 11 as the connection neck 17, for example.

A pressure regulator 43 is disposed on a second end 41 of the tubular distributor housing 11, this second end being opposite the first end 19, extending approximately concentrically with the longitudinal axis 13. The pressure regulator 43 protrudes into the through opening 1 of the distributor housing 11 and is partly surrounded by this second end 41 in the axial direction.

A central return end 45 of the pressure regulator 43 protrudes into the through opening 15 of the distributor housing 11 toward the connection cap 21 and extends approximately concentrically with the longitudinal axis 13; it is surrounded by a tubular central return line 47, which may for instance be of aluminum or steel or of some other metal material or plastic. The tubular return line 47 extends, radially spaced apart from the wall of the through opening 15, approximately concentrically with the longitudinal axis 13, as far as the inside of the return opening 35 of the connection cap 21, and thus establishes communication between the return end 45 and the pressure regulator 3 and the return neck 33 of the connection cap 21.

An annular inlet cross section 9 surrounding the return line 47 is formed between the circumference of the return line 47, which for example has a circular-annular cross section, and the wall of a flow segment 107 of the through opening 15 of the distributor housing 11; in the region between the first end 19 and second end 41 of the distributor housing 11, this flow segment 107 has a square, circular or arbitrary other cross section, by way of example. The inlet cross section 49 communicates with the inlet neck 37 and, via the connection neck 17 of the distributor housing 11, with the fuel delivery necks 7 of the fuel injection valves 3.

For positional fixation of the fuel injection valves 3 with respect to the fuel distributor 1, a connecting element 51 in the form of a clamp is provided on each of the connection necks 17 of the distributor housing 11; each clamp engages a circumferential groove 53 of the fuel delivery neck 7 of each fuel injection valve 3 and fits over a locking collar 55 on an end of each connection neck 17 toward each fuel injection valve 3. To prevent twisting of the fuel injection valves 3 relative to the fuel distributor 1, each connection element 51 has an upper fixation element 57 and a lower fixation element 59; the fixation element 57, 59 form-fittingly fits around either a first positioning protrusion 61, formed on the circumference of each connection neck 17 of the distributor housing 11, or a second positioning protrusion 63 formed on the circumference of each fuel delivery neck 7 of the fuel injection valve 3, doing so at least in the circumferential direction.

In the region protruding into the connection opening 18 of the connection neck 17 of the distributor housing 11, a sealing ring 67 is disposed in an annular groove 65 of the fuel injection valve 3 on the circumference of the fuel delivery neck 7 of the each fuel injection valve 3; the sealing ring prevents fuel from escaping between the circumference of the fuel injection valve 3 and the wall of the connection opening 18 of the connection neck 17.

The fuel, arriving from a fuel source such as a fuel pump, flows through the inlet opening 39 of the inlet neck 37 on the first end 19 of the fuel distributor 1 into the inlet cross section 49 formed between the circumference of the return line 47 and the inner wall of the distributor housing 11 and supplies the fuel injection valves 3 through the connection necks 17 of the distributor housing 11. On the second end 41 of the distributor housing 11, the fuel flows into the pressure regulator 43, disposed on the face end, which constantly regulates the predetermined system pressure in the inlet cross section 49. The excess fuel, if the fuel pressure in the inlet cross section 49 exceeds the system pressure, flows out of the return end 45 of the pressure regulator 43 and flows without pressure back to a fuel tank, not shown, through the central return line 47 and the return opening 35 of the connection cap 21, via the return neck 33.

In the first exemplary embodiment shown in FIG. 1, an annular groove 71 is formed out of a cylindrical segment 69 of the connection cap 21 protruding into a widened segment 70 of the through opening 15 of the distributor housing 11 and bordering on the retaining flange 23; a sealing ring 72 is disposed in this groove and provides sealing between the circumference of the cylindrical segment 69 and the wall of the widened segment 70 of the through opening 15 of the distributor housing 11.

On its end toward the pressure regulator 43, the return opening 35 of the connection cap 21 has a receiving segment 74 with an enlarged inside diameter, as well as a guide segment 76 adjoining it toward the return neck 33 and having a smaller inside diameter than the receiving segment 74. The return line 47, extending approximately concentrically with the longitudinal axis 13 of the valve housing 11 and protruding into the return opening 35 of the connection cap 21 extends all the way through the receiving segment 74 until reaching the inside of the guide segment 76 of the connection cap 21. By way of example, the receiving segment 74 and the guide segment 76 are circular in embodiment. On its end protruding into the connection cap 21, the return line 47 is closely surrounded by the guide segment 76 of the return opening 35. In the region surrounding the receiving segment 74 of the return opening 35, the return line 47 has a radially outwardly extending collar 78. Between the collar 78 and a side face 80 of the connection cap 21 that is formed, toward the return neck 33 of the connection cap 21 and extending approximately vertically to the longitudinal axis 13 between the receiving segment 74 and the guide segment 76 having a reduced inside diameter compared with the receiving segment 74, a sealing ring 82 mounted on the return line 47 is disposed in an annular chamber 83, providing sealing between the circumference of the return line 47 and the wall of the receiving segment 74. In the direction of the longitudinal axis 13, the annular chamber 83 is defined by the collar 78 and the side face 80, and vertically thereof in the radial direction by the circumference of the return line 47 and the wall of the receiving segment 74 of the return opening 3 of the connection cap 21.

Embodying an annular chamber in this way avoids the problem of burrs from mold separation, in the case of a connection cap 21 for instance made by plastic injection molding.

The second end 41 of the distributor housing 11 has a first parallel segment 85 and an adjoining second parallel segment 86, remote from the connection cap 21. The first parallel segment 85 has a greater inside diameter than the segment of the through opening 15 receiving the return line 47, and the second parallel segment 86 has a greater inside diameter than the first parallel segment 85. The first parallel segment 85 and the second parallel segment 86 of the through opening 15 have a circular cross section, for example. The parallel segments 85, 86 protrude axially virtually beyond the connection of the pressure regulator 43.

Between the circumference of the pressure regulator 43, which is provided with a stepped housing, and the wall of the first parallel segment 85, a sealing ring 88 is disposed in an annular groove 87 formed on the circumference of the pressure regulator 43. By means of a retaining clamp 90 disposed on its end remote from the return end 45, the pressure regulator 43 is held in contact with a shoulder 141, formed between the parallel segments, 85, 86, on the second end 41 of the distributor housing 11; this effectively prevents shifting of the pressure regulator 43 in the direction of the longitudinal axis 13 of the distributor housing 11.

Between the circumference of the return end 45 of the pressure regulator 43 and the inner wall of the tubular return line 47, a sealing ring 93 is disposed in an annular groove 92 of the return end 45; it reliably prevents fuel from flowing past it between the return end 45 of the pressure regulator 43 and the inner wall of the return line 47.

In FIGS. 2–7, a second exemplary embodiment of a fuel distributor according to the invention is shown in fragmentary form; elements that are the same and function the same are identified by the same reference numerals as in FIG. 1.

Figure 2:
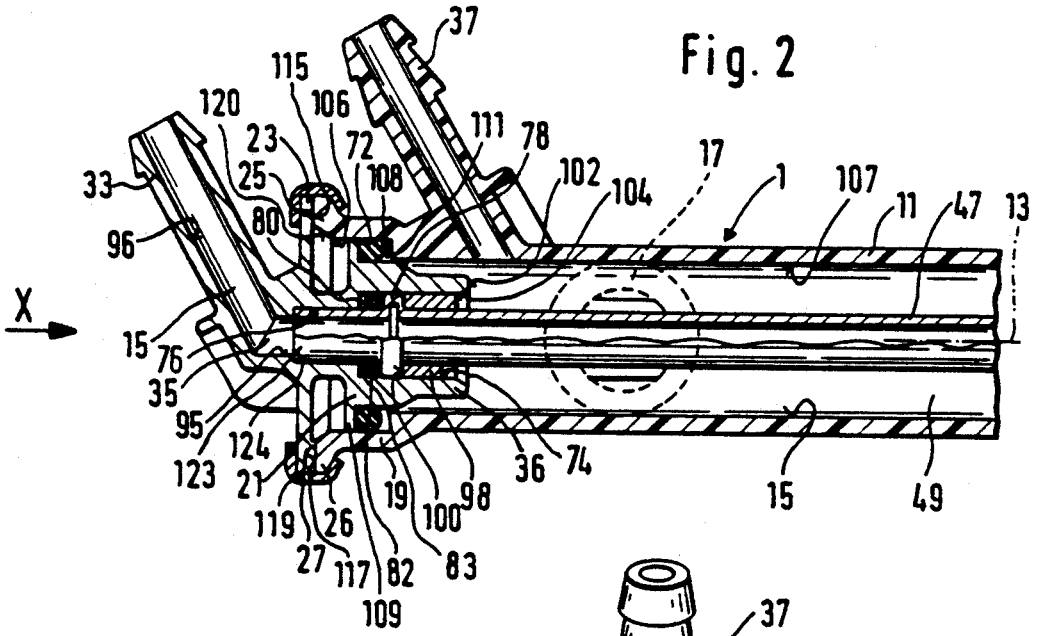
FIG. 2 is a fragmentary view of a fuel distributor according to the invention in a second exemplary embodiment.
Figure 3:
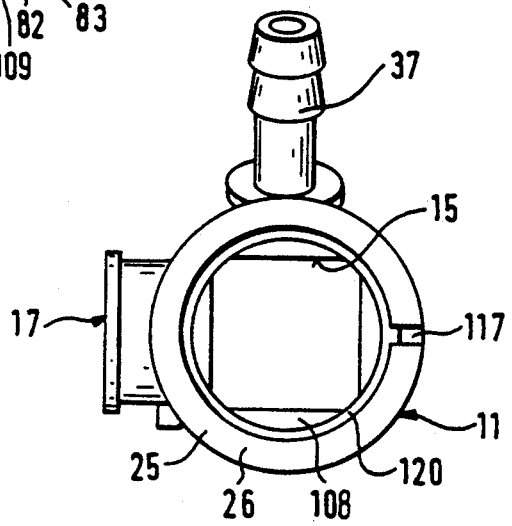
FIG. 3 is a view of the distributor housing in the direction of the arrow X of FIG. 2.

FIGS. 2 and 3 show the first end 19 of the fuel distributor 1, that is, the end having the inlet neck 37 and the return neck 33; in FIG. 3, which is a view of the distributor housing 11 in the direction of the arrow X in FIG. 2, the connection cap 21 has not been shown, for simplicity. In contrast to the first exemplary embodiment shown in FIG. 1, the inlet neck 37 of the distributor housing 11 is not inclined in the direction of the connection necks 17 but rather extends at right angles to the plane formed by the connection necks 17, extending obliquely with respect to the longitudinal axis 13 in the direction of the retaining flange 23 of the connection cap 21. The return neck 33 of the connection cap 21 extends obliquely to the longitudinal axis 13, for example parallel to the inlet neck 37. This parallel disposition of the inlet neck 37 and return neck 33 facilitates connecting the fuel distributor 1 of the invention to fuel inlet and return lines and facilitates mounting the fuel distributor 1, for instance in a motor vehicle engine compartment. The return opening 35 of the connection cap 21 has a first, central flow segment 95, extending approximately concentrically with the longitudinal axis 13, and a second flow segment 96 in the region of the return neck 33, extending obliquely relative to the longitudinal axis 13 in the direction of the return neck 33.

The stepped return opening 35 of the connection cap 21, the region of its first flow segment 95 on its end remote from the return neck 33, has the receiving segment 74 having an enlarged inside diameter and, toward the return neck 33, the guide segment 76 adjoining the receiving segment 74; the receiving segment 74 has a larger inside diameter than the guide segment 76. The receiving segment 74 and guide segment 76 have a circular cross section, by way of example. The return line 47, extending centrally and with radial spacing from the through opening 15 of the distributor housing 11, extends all the way through the receiving segment 74 as far as the inside of the guide segment 76 of the first flow segment 95 of the return opening 35. On its end protruding into the connection cap 21, the return line 47 is surrounded closely, with only slight play, by the guide segment 76 of the return opening 35. Between the collar 78 of the return line 47, in the region of the receiving segment 74 and the side face 80 of the connection cap 21 that is approximately perpendicular of the longitudinal axis 13, and which face is formed between the receiving segment 74 and the guide segment 76 having the smaller inside diameter, the sealing ring 82 is disposed in the annular chamber 83. The annular chamber 83 is defined in the direction of the longitudinal axis 13 of the distributor housing 11 by the collar 78 of the return line 47 and the side face 80 of the connection cap 21, and at right angles thereto by the circumference of the return line 47 and the wall of the receiving segment 94 of the return opening 35. A bush 98 is pressed into the receiving segment 74 of the return opening 35 in such a way, for example, that the bush 98 rests by its face end 100 toward the return neck 33 on the collar 78 of the return line 47. The bush 98 serves the purpose of fixation of the return line 47 in the direction of the longitudinal axis 13 of the distributor housing 11, with respect to the connection cap 21 and thus with respect to the distributor housing 11 of the fuel distributor 1. To assure a secure hold of the bush 98 in the receiving segment 74 of the connection cap 21, it is suitable if the bush 98 has a very rough and uneven surface, for example one provided with notches, on its circumference. The bush 98 surrounds the circumference of the return line 47 with slight radial play. To facilitate introducing the bush into the receiving segment 74, the stepped return opening 35 is provided with a chamfer 104, on a end face 102 remote from the return neck 33 of the connection cap 21.

It is possible to push the bush 98 so far into the receiving segment 74 of the connection cap 21 that the return line 47 rests by one end face 123 on a retaining shoulder 124, bordering the guide segment 76, of the first flow segment 95 of the return opening 35.

However, it is also possible, instead of the bush 98, to use a shim or a securing ring or some other device for axial positional fixation of the return line 47 in the through opening 15 of the distributor housing 11.

On its end toward the retaining flange 23 of the connection cap 21, the through opening 15 of the distributor housing 11 has a cylindrical parallel segment 106, which has an enlarged inside diameter with respect to the flow segment 107 of the through opening 15, this flow segment being for instance approximately square and formed out between the connection cap 21 and the pressure regulator 43. Between the cylindrical parallel segment 106 and the flow segment 107, which for instance is virtually square, a radially inwardly pointing bearing face 108 is formed virtually at right angles to the longitudinal axis; it is oriented toward the return neck 33 of the connection cap 21. A support flange 109 extending radially outward is formed out of the circumference of the connection cap 21 and extends to near the cylindrical parallel segment 107 of the through opening 15. The sealing ring 72 is disposed in an annular chamber 111, which in the direction of the longitudinal axis 13 of the distributor housing 11, toward the return neck 33, is formed by the support flange 109, and toward the end face 102 of the connection cap 21 is formed by the bearing face 108, and at right angles thereto is formed by the circumference of the connection cap 21 and the cylindrical parallel segment 106 of the distributor housing 11.

To prevent twisting of the connection cap 21 relative to the distributor housing 11, a recess 117 is provided on the end face 25 of the distributor housing 11 on which the connection cap 21 rests by an end face 115 of its retaining flange 23. This recess 117 cooperates with a positioning protrusion 119 formed on the face end 115 of the retaining flange 23.

However, it is also possible to provide the recess 117 on the face end 115 of the retaining flange 23 and to provide the positioning protrusion 119 on the end face 25 of the distributor housing 11, instead.

To facilitate the introduction of the connection cap 21 into the through opening 15 of the distributor housing 11, the through opening 15 has a chamfer 120 on the end face 25 of the distributor housing 11.

Figure 4:
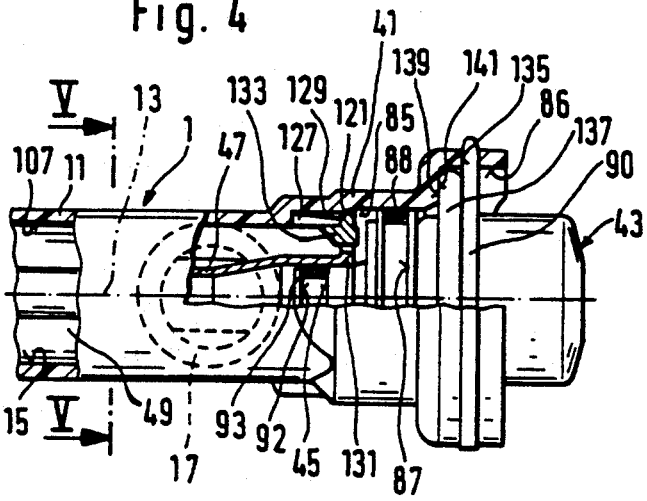
FIG. 4 is a fragmentary view of the fuel distributor in accordance with the second exemplary embodiment.
Figure 5:
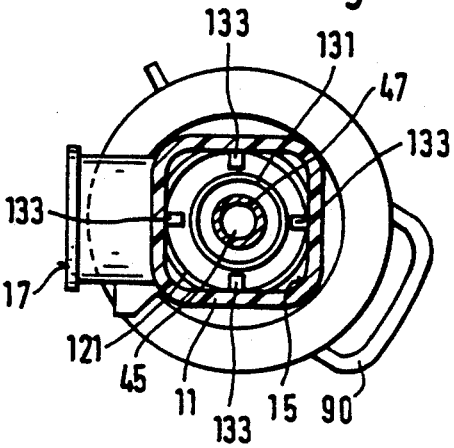
FIG. 5 is a section taken along the line V—V of FIG. 4.
Figure 6:
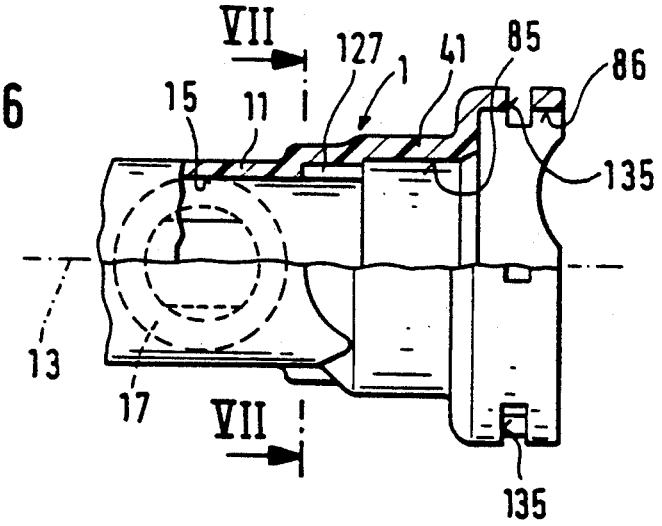
FIG. 6 is a fragmentary view of the distributor housing of the second exemplary embodiment of the invention.
Figure 7:
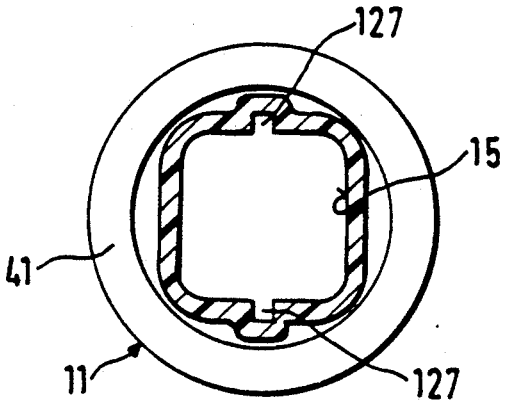
FIG. 7 is a section taken along the line VII—VII of FIG. 6.

FIGS. 4–7, the second end 41 of the fuel distributor 1 having the pressure regulator 43 is shown; FIG. 5 is a section taken along the line V—V of FIG. 4, FIG. 6 shows the second end of the distributor housing 11 without the pressure regulator 43 and return line 47, and FIG. 7 is a section taken along the line VII—VII of FIG. 6.

To enable problem-free mounting of the pressure regulator 43 in the through opening 15 of the second end 41 of the distributor housing 11, it is suitable for the return line 47 to be at least virtually centered in the through opening 15 in the region of the second end 41 of the distributor housing 11. To that end, at least one spacer 121 is disposed on the second end 41 in the radial direction between the circumference of the return line 47 and the inner wall of the through opening 15. The spacer 121 rests by its circumference, at least partly, for instance in the region of the first parallel segment 85, on the wall of the through opening 15. It is also possible, however, for a plurality of spacers 121 to be provided between the circumference of the return line 47 and the inner wall of the through opening 15.

The spacer 121 may, as in the exemplary embodiment shown, be retained by a press fit, or also by radially outwardly directed spreading forces in the through opening 15 of the distributor housing 11, without any danger that the spacer 121 might shift in the direction of the longitudinal axis 13. It is also possible for the spacer 121 to be fixed relative to the through opening 15 of the distributor housing 11 in the direction of the longitudinal axis 13, by means of a snap connection formed on its circumference, for example.

The flow segment 107, which for instance is virtually square, of the through opening 15 of the distributor housing 11 has, bordering directly on the first parallel segment 85 of the through opening 15, at least one and in the second exemplary embodiment shown two slits 127, by way of example. Protruding into the slits 127 are for instance two positioning protrusions 129, formed on the spacer 121 and preventing twisting of the spacer 121 relative to the distributor housing 11. Naturally, the spacer 121 is embodied such that it hinders the fuel flows around the return line 47 as little as possible.

On its end at least partially surrounding the return end 45 of the pressure regulator 43, the return line 47 has a collar 131 pointing radially outward, approximately at right angles to the longitudinal axis 13 of the distributor housing 11. A plurality of cams 133 are formed on the spacer 121, pointing radially inward to the collar 131 of the return line 47; in the exemplary embodiment shown in FIGS. 2–7, there are four cams 133, for example, which may be embodied as elastically resilient to a limited extent. The cams 133 of the spacer 121 are located facing the collar 131 of the return line 147 in the radial direction, and they limit the offset of the return line 47 on its collar 131 with respect to the longitudinal axis 13 of the distributor housing 11 in the radial direction and thus facilitate the mounting of the pressure regulator 43 and the introduction of the return end 45 of the pressure regulator 43 into the return line 47, without there being any danger of damage to the sealing rings 88, 93 disposed on the circumference of the pressure regulator 43. On account of production tolerances which may possibly arrive, the length of the cams 133 in the direction of the longitudinal axis 13 is greater than the length of the collar 131 of the return line 147 in the direction of the longitudinal axis 13.

On its second end 41, for instance in the region of the second parallel segment 86, the circumference of the distributor housing 11 has slits 135, for instance two in number, which extend at right angles to the longitudinal axis 13 of the distributor housing 11. Some of the slits 135 extend through the wall of the distributor housing 11 to the inside of the through opening 15. The pressure regulator 43 has on its circumference a retaining flange 137 pointing radially outward virtually at right angles to the longitudinal axis 13; with its end face 139 toward the return line 47, this retaining flange rests on the radially extending shoulder 141 formed between the first parallel segment 85 and the second parallel segment 86. The retaining clamp 90 is disposed on the circumference of the distributor housing 11 in the slits 135 in such a way that after the mounting of the fuel distributor 1, it rests with a radially oriented initial tension on the circumference of the pressure regulator 43, on the side of the retaining flange 137 remote from the return line 47, and thus fixes the position of the pressure regulator 43 in the direction of the longitudinal axis 13.

Figure 10:
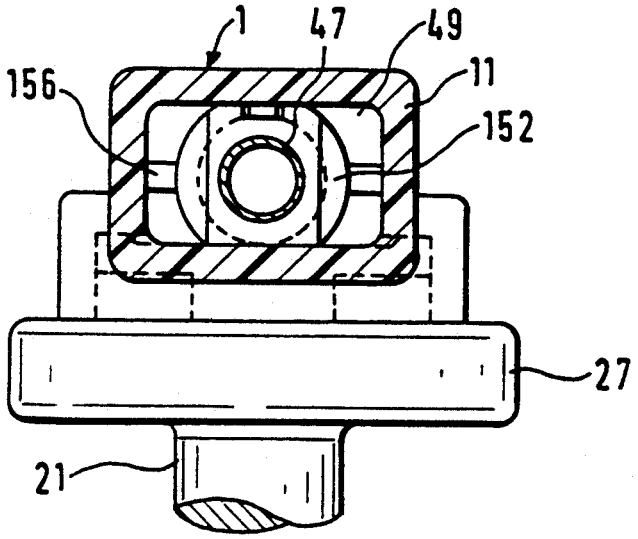
FIG. 10 is a section taken along the line X—X of FIG. 8.
Figure 8:
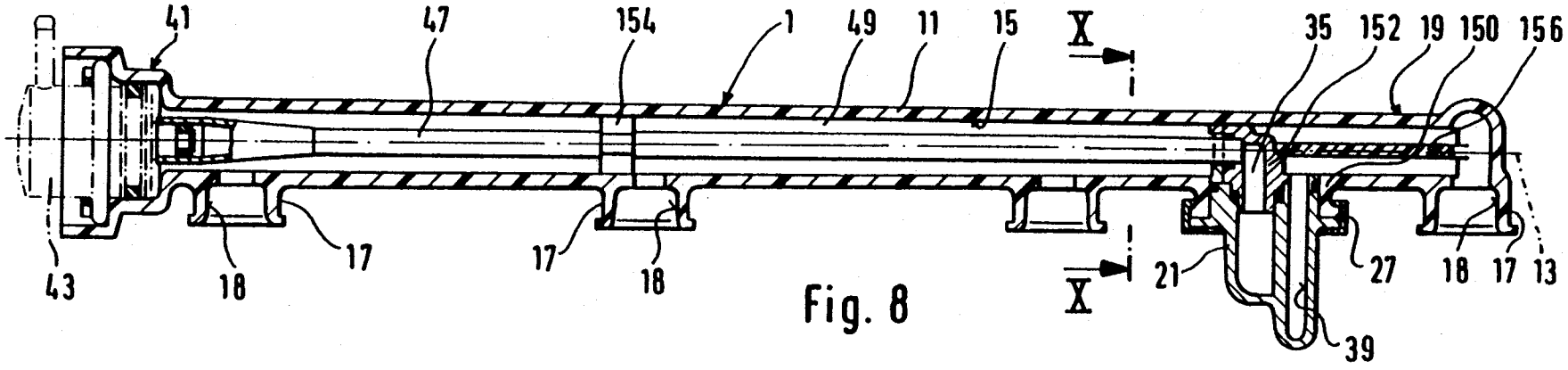
FIGS. 8 and 9 show a fuel distributor in a third exemplary embodiment.
Figure 9:
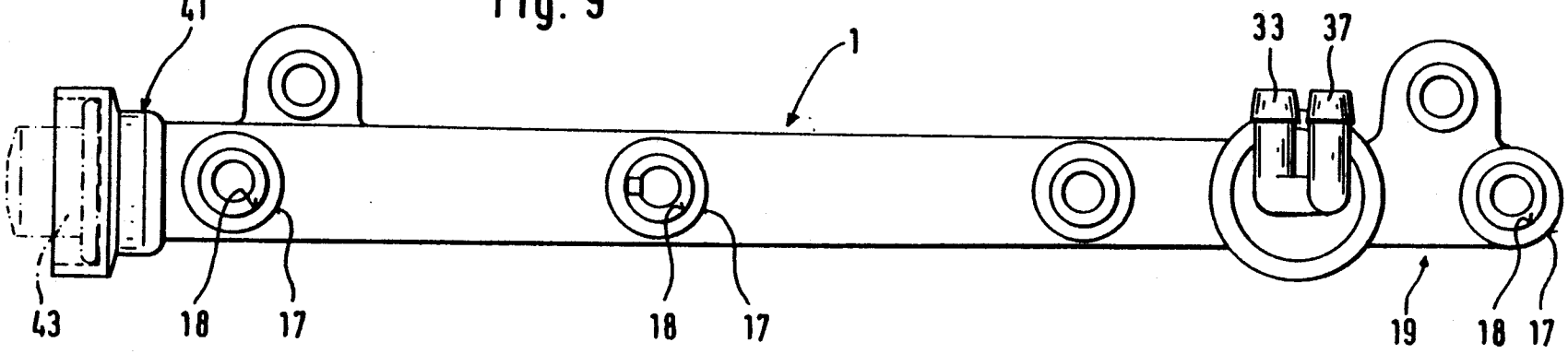

A fuel distributor of a third exemplary embodiment of the invention is shown in FIGS. 8–10; FIG. 10 shows a section taken along the line X—X of FIG. 8. Elements that are the same and function the same are identified by the same reference numerals as in FIGS. 1–7. In the vicinity of the first end 19, not on its end face but on its circumference transversely to the longitudinal axis 13, the distributor housing 11 has a connection flange 150, into which the connection cap 21 protrudes and with which the connection cap 21 is connected by means of the edge-formed ring 27. The inlet neck 37 is also formed onto the connection cap 21, jointly with the return neck 33, and serves to supply fuel to the fuel distributor 1. A return part 152, which is disposed in the region of the connection flange 150 on the connection cap 21 and in which the return opening 35 is embodied protrudes transversely into the through opening 15 of the distributor housing 11; it is partly surrounded by the connection cap 21. The return portion 152 rests partly on the wall of the through opening 15, which is for instance virtually rectangular. The return opening 35 of the return part 152 communicates with the return line 47 extending centrally in the through opening 15 and connects the return line 47 to the return neck 33 that is jointly formed onto the connection cap 21. One of the connection necks 17 is formed directly on the first end 19 of the distributor housing 11, and the connection flange 150 is located in the space between it and the next connection neck 17. Between the mouth of the inlet opening 39 of the inlet neck 37 into the inlet cross section 49 and the connection neck 17 disposed on the first end 19, remote from the pressure regulator 43, a rib 156 is formed in the through opening 15 of the distributor housing 11; it serves to deflect the flow of fuel entering the distributor housing 11 and assures a reliable supply of fuel to the connection neck 17 disposed on the first end 19. The rib 156 extends in the form of a transverse wall, preferably over the entire width of the through opening 15, approximately at the level of the longitudinal axis 13 and transversely to the inlet opening 39; in the axial direction, it extends approximately from the return part 152 to near the connection neck 17 on the first end 19.

A tube holder 154 is disposed in the through opening 15, between the circumference of the return line 47 and the wall of the inlet cross section 49; it limits the offset of the return line 47 relative to the longitudinal axis 13 of the distributor housing 11.

The fuel distributor 1 according to the invention has the advantage of a very slender and compact structure. The space required by the fuel distributor 1, for instance in the engine compartment of a vehicle, is substantially less; the available space in the engine compartment is suitably utilized, and mounting of the fuel distributor 1 by a one-sided connection is facilitated.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing and which is thrust into a guide segment (76) of the connection cap (21); and that the inlet cross section (49) is formed between the circumference of the return line (47) and the inner wall of the distributor housing (11), and the return line (47) has a collar (78), by which it protrudes into a receiving segment (74) of the connection cap (21), and a bush (98) which engages the collar (78) fixes the return line (47) in the receiving segment (74).

2. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing; that the inlet cross section (49) is formed between the circumference of the return line (47) and the inner wall of the distributor housing (11), at least one spacer (121) is disposed in the inlet cross section (49) of the distributor housing (11), between the wall of the inlet cross section (49) and the return line (47), and the spacer (121) has a plurality of radially inwardly pointing cams (133) at right angles to the longitudinal axis (13) of the distributor housing (11), which are radially opposite a collar (131) of the return line (47).

3. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing; that the inlet cross section (49) is formed between the circumference of the return line (47) and the inner wall of the distributor housing (11); and at least one slit (135) is formed on a circumference of the distributor housing (11) on its second end (41) that receive the pressure regulator (43) and extends vertically of the longitudinal axis (13), through which slit a retaining clamp (90) protrudes partway and rests on the circumference of the pressure regulator (43) with an initial tension oriented toward the longitudinal axis (13).

4. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing; that the inlet cross section (49) is formed between the circumference of the return line (47) and the inner wall of the distributor housing (11); and a recess (117) is provided on an end face (25) of the distributor housing (11) toward the connection cap (21), which recess cooperates with a positioning protrusion (119) formed on an end face (115) of the connection cap (21).

5. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing; that the inlet cross section (49) is formed between the circumference of the return line (47) and the inner wall of the distributor housing (11); and an annular chamber (111) is formed in the direction of the longitudinal axis (13) of the distributor housing (11) between a support flange (109) on the circumference of the connection cap (21) and a bearing face (108) of the distributor housing (11) and between the circumference of the connection cap (21) and the wall of the inlet cross section (49) of the distributor housing (11), in which a sealing ring (72) is disposed.

6. A fuel distributor for fuel injection systems of internal combustion engines for supplying fuel to at least two fuel injection valves, having a first end and a second end and a longitudinal axis; an inlet neck and a return neck; a tubular distributor housing which has a number of connection necks for the fuel injection valves corresponding to the number of fuel injection valves; an inlet cross section in the distributor housing that communicates with the inlet neck and the connection necks; a pressure regulator disposed on the second end of the fuel distributor; a connection cap (21) having the return neck (33) is secured juxtaposed the first end (19) of the tubular distributor housing (11) of the fuel distributor (1), and the inlet neck (37) is juxtaposed the first end (19) of the tubular distributor housing (11) of the fuel distributor (1) and on the second end (41), the pressure regulator (43) protrudes by a return end (45) into the distributor housing (11) approximately concentrically with the longitudinal axis (13) of the distributor housing (11); that the return end (45) of the pressure regulator (43) and the return neck (33) of the connection cap (21) communicate with one another through a central tubular return line (47) extending in the distributor housing (11) with radial spacing; that the inlet cross section (49) is formed between the circumference of the return line (47) and the inner wall of the distributor housing (11); and the concoction cap (21) is disposed on a connection flange (150) of the distributor housing (11), which flange is located between two connection necks (17) for the fuel injection valves.

7. A fuel distributor as defined by claim 1, in which the connection cap (21) is disposed on an end face on the first end (19) of the distributor housing (11), and that the return neck (33) is formed centrally on the connection cap (21) and the inlet neck (37) is formed relative to the first end (19) of the distributor housing (11).

8. A fuel distributor as defined by claim 1, in which an annular chamber (83), is formed in the direction of the longitudinal axis (13) of the distributor housing (11) between the collar (78) of the return line (47) and a side face (80) of the receiving segment (74) of the connection cap (21) and between the circumference of the return line (47) and the wall of the receiving segment (74), in which a scaling ring (82) is disposed.

9. A fuel distributor as defined by claim 7, in which an annular chamber (83), is formed in the direction of the longitudinal axis (13) of the distributor housing (11) between the collar (78) of the return line (47) and a side face (80) of the receiving segment (74) of the connection cap (21) and between the circumference of the return line (47) and the wall of the receiving segment (74), in which a scaling ring (82) is disposed.

10. A fuel distributor as defined by claim 1, in which inlet necks (37) and return necks (33) are disposed on the connection cap (21).

11. A fuel distributor as defined by claim 6, in which inlet necks (37) and return necks (33) are disposed on the connection cap (21).

* * * * *